United States Patent [19]

Trojani

[11] 4,286,655

[45] Sep. 1, 1981

[54] FINNED TUBE FOR HEAT EXCHANGERS

[76] Inventor: Benito L. Trojani, Via Polar, 8, Lugano, Breganzona, Switzerland

[21] Appl. No.: 66,434

[22] Filed: Aug. 14, 1979

[30] Foreign Application Priority Data

May 21, 1979 [IT] Italy ..... 22856 A/79

[51] Int. Cl.[3] ..... F28F 1/42; B21D 53/00

[52] U.S. Cl. ..... 165/179; 29/157.3 A; 29/157.3 AH; 113/118 A; 138/38; 165/181; 165/184

[58] Field of Search ..... 165/179, 181, 177, 182, 165/183, 184; 29/157.3 A, 157.3 B, 157.3 AH; 113/118 A, 118 B; 138/38, 155, 171, 161, 163

[56] References Cited

U.S. PATENT DOCUMENTS

| | | | |
|---|---|---|---|
| 1,677,714 | 7/1928 | Frease | 138/115 |
| 1,777,782 | 10/1930 | Bundy | 138/38 |
| 2,394,396 | 2/1946 | Mouromtseff et al. | 29/157.3 |
| 2,483,454 | 10/1949 | Brown | 29/157.3 |
| 2,929,408 | 3/1960 | Weatherwax et al. | 138/38 |
| 2,930,405 | 3/1960 | Welsh | 138/38 |
| 3,022,049 | 2/1962 | Abbott | 29/157.3 |
| 3,068,905 | 12/1962 | Millington et al. | 138/38 |
| 3,140,378 | 7/1964 | Benninghoff | 29/157.3 |
| 3,255,516 | 6/1966 | Sommer | 29/157.3 |
| 3,528,494 | 9/1970 | Levedahl | 165/179 |

*Primary Examiner*—Daniel J. O'Connor
*Attorney, Agent, or Firm*—Bucknam and Archer

[57] ABSTRACT

A finned tube for heat exchangers comprises a plurality of sections adjoining to one another. The sections are of V-shape, define a central core, and are provided with arc-shaped wings. The sections are associated to one another by superimposing the wings of the adjoining section wings. The sections are connected by longitudinal welding. The finning is formed by a metal band applied on the outside of the tube. According to one embodiment, each section has a substantially T-shaped cross-section. The metal band may have a plurality of notches.

8 Claims, 9 Drawing Figures

Fig. 1
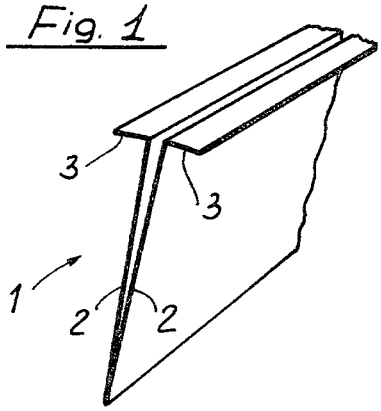
Fig. 6
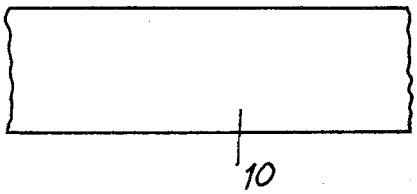
Fig. 3
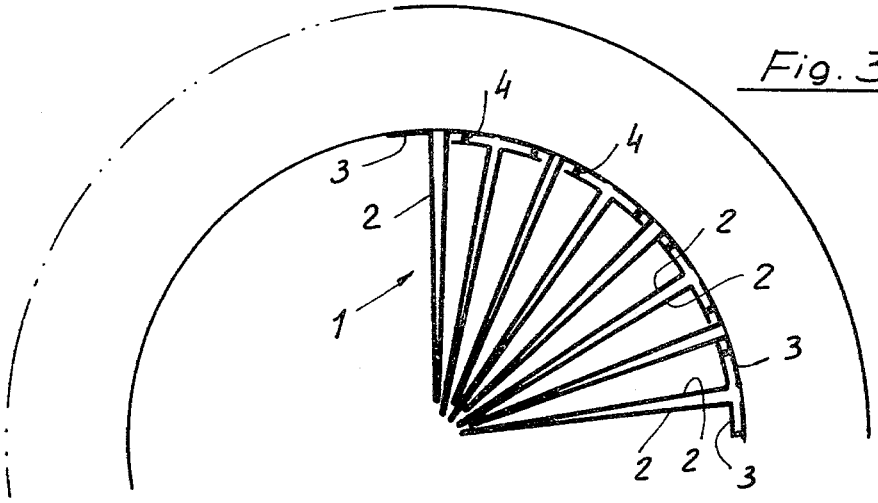
Fig. 2
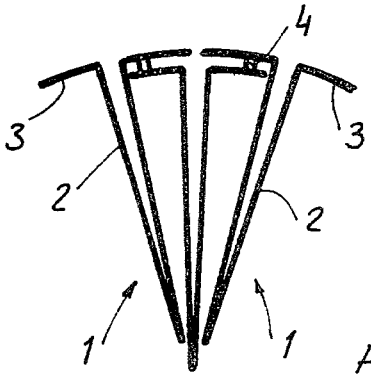
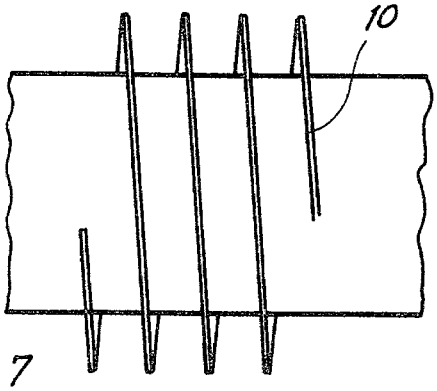
Fig. 7

FINNED TUBE FOR HEAT EXCHANGERS

The present invention relates to a finned tube, particularly for making heat exchangers.

In applicant's copending Patent Application Ser. No. 064,094, filed Aug. 6, 1979, there, is described a tube provided with inner fins and outer fins or pins, for making heat exchangers, a characteristic feature of which is that the finned tube is obtained by welding together a plurality of sections.

The section are each provided with a wing or rib curved according to a circle arc, in such a way as to present a substantially T, L, U or Z shaped cross-section.

This tube, while having provided rather satisfactory results, is capable of being improved, however, mainly with respect to a further enhancement or improvement in the thermal exchange within the tube itself. In the aforementioned tube, the fins extend only partially into the fluid stream.

Due to this reason, the central fluid flow, passing in the inside of the tube, does not contact, or only partially is in contact with the thermal exchanging zones, thereby preventing the efficiency of the heat exchanger from being optimized.

Another aspect discovered to be susceptible to improvement, is the tube inside surface-outer surface ratio. Heat exchangers, as obtained by the thereinabove described tube, are generally used for the thermal regeneration of a heated fluid stream contacting the tube on the outside or outer portion, transferring thermal energy to a lower temperature fluid flowing inside said tube.

Accordingly, a purpose of the present invention is to eliminate the aforesaid drawbacks by providing a tube which, while preserving the inventive concept of the tube according to the aforesaid Patent Application of the same Applicant, is able to improve in a rather sensible way the thermal efficiency of the tube.

In order to accomplish said purpose it is a specific object of the invention to provide a finned tube permitting an increase, the size being the same, in the thermal exchange surfaces, and which, furthermore, makes it possible to involve all the fluid flow in the inside of the tube, without causing fluid-dynamics resistance to occur, which resistance, by causing fluid stagnation in some portions of said tube to occur would decrease the thermal efficiency thereof.

Another object of the present invention is to provide a greatly simplified tube which, moreover, does not present any assembling problems.

Another object of the present invention is to provide such a tube which may be formed by sections which are readily obtained from conventional materials and techniques while being greatly competitive from an economic point of view.

The aforesaid purpose and objects, as well as other objects which will become more apparent hereinafter, are achieved by a finned tube specifically designed for making heat exchangers, comprising a plurality of adjoining sections so welded to one another as to form a tube according to the aforesaid earlier invention.

Said sections define, as seen in cross section, a central core substantially radially extending with respect to said tube, and provided, at one end thereof, with wings shaped according to a circle arc.

The aforesaid sections may be associated to one another by superimposing said wings on the adjoining section wings, being furthermore provided with a plurality of fins peripherally located on the outside surface of said tube.

Further characteristics and advantages will become more apparent from the following detailed description of exemplary preferred embodiments of a finned tube, illustrated as a non-limitative example in the accompanying drawings where:

FIG. 1 is a perspective view illustrating a first embodiment of the sections forming the instant tube;

FIG. 2 schematically illustrates the assembling or mounting of three sections;

FIG. 3 illustrates another embodiment of the instant tube for making a heat exchanger;

FIG. 6 is a plan view illustrating a smooth outside fin shape;

FIG. 7 illustrates a tube provided with a plurality of outside fins, formed by the fins illustrated in FIG. 6;

Figure 4:
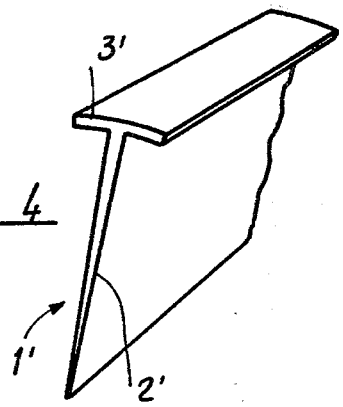
FIG. 4 is a perspective view illustrating a second embodiment of said sections.
Figure 8:
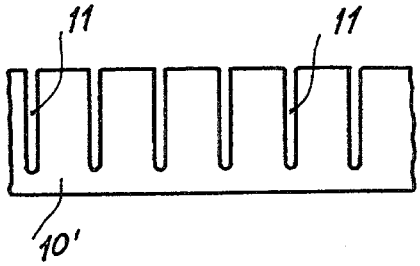
FIG. 8 illustrates ragged outside fins.

Referring particularly to the aforesaid figures, the finned tube according to the invention comprises a plurality of sections, indicated at (1) in FIG. 1, which have a substantially V-shaped cross-section, the V legs being located very close to one another and forming the central section core.

More specifically, said section (1) is provided with a leg pair (2), which legs, at the end opposed to the apex, are connected to wings (3) said wings having a circle arc shape.

In the embodiment illustrated in FIG. 1, each section is formed in practice by a plate sheet element, as bent and shaped in such a way as to assume the desired V-shape.

For connecting to one another said sections (1), in order to make the heat exchanger tube, the wings (3) of a section (1) are superimposed on the wings (3) of the adjoining sections.

At the wing (3) superimposition zone, which wings, as thereinabove stated, have a circle arc shape, longitudinal weldings (4) are carried out, in the axial direction of the tube to be made, in such a way as to assure a perfect tightness between the inside and outside thereof.

As it is illustrated in FIG. 3 in a more detailed way, the sections, (1) are located offset from one another, in such a way that a half of said sections are located on the inside, the other half of said sections having the wings thereof located on the outside of the inner section wings.

Figure 5:
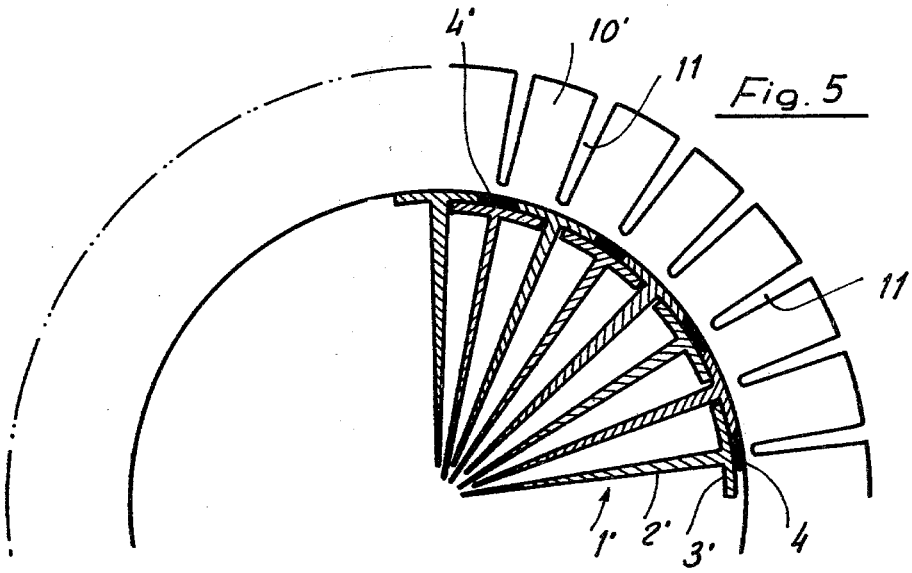
FIG. 5 is a cross-section view illustrating a heat exchanger as obtained by using the sections illustrated in FIG. 4.
Figure 9:
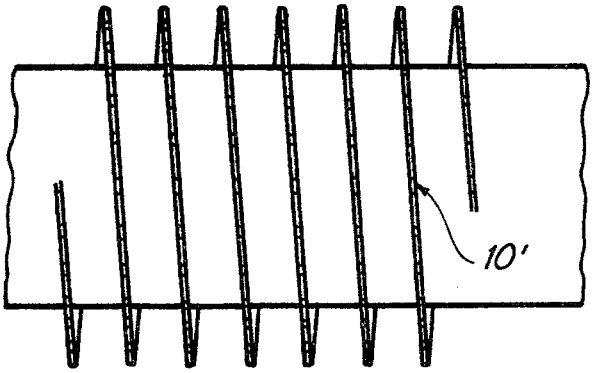
FIG. 9 illustrates a heat exchanger made by using the outside fins illustrated in FIG. 8.

According to a further embodiment illustrated in FIGS. 4 and 5, the sections, indicated by the reference number (1'), have a substantially T-shaped cross-section and are preferably made by extrusion, in such a way as to present a solid cross-section.

More specifically, the central core (2') which in practice of form the T-stem, has a shape tapering towards the center of the core, while the wings (3'), which are circle arc shaped, have a cross-section width which is substantially equal to that of the engaging zone with said stem (2').

Also in this case, the connection to one another of the several sections is carried out by superimposing the wings (3') of a section (1') on the wings (3') of the adjoining sections.

Furthermore, the connection to one another of the several sections is carried out by means of a longitudinal welding (4), longitudinally extending with respect to the longitudinal direction of said sections, and in practice extending through the central portion of the wings of a sections (1') and through the ends of the wings (3') of the adjoining sections (1').

Also with this embodiment the free ends of the central core (2') extend as far as the proximity of the tube circumference center, as defined by adjoining several sections.

In this way it is assured that all the streamlines of the fluid passing through the tube contact a portion of the sections in order to perform a suitable and required thermal exchange.

On the outside of the tube formed either by sections (1) or sections (1') an outside finning is provided which is formed, as it is illustrated in FIGS. 6 and 7, by a metal band, indicated at (10).

This latter is edge wrapped according to a helical configuration, with respect to the axis of the tube defined by the mutual connection of the several sections.

According to another embodiment, the outside finning is obtained by a ragged band, indicated at (10') which is provided with notches (11) perpendicularly extending with respect to said band direction, and partially formed through the width of said band.

Also in this case, the band is edge wrapped, according to a helical configuration, on the outside surface of the tube thereby in practice providing a ragged outside finning.

From experiments it has been observed that in order to obtain a good yield in the heat exchanger incorporating a tube according to the invention, the outside-finning surface has to be substantially equal with respect to the surface of the inside finning, which latter is defined by the inside portions of the adjoining sections.

From the above description, it should be apparent that the invention fully achieves the intended objects and in particular it is pointed out that the use of sections defining a central core extending towards the center as close as possible assures that in the inside of the tube a plurality of small channels are formed.

These latter are delimited by the several adjoining cores which, while presenting a low fluid-dynamic resistance, permit an optimal fluid passing through to be obtained, without stagnations, and hence with a very high thermal transmission coefficient, thereby assuring an optimal efficiency to the thus obtained exchanger.

Another important characteristic of the invention consists of the great simplicity in assembling and making, which is achieved by superimposing onto one another the wings, with the certainty of a precise and sure coupling.

Obviously the invention, as designed, is susceptible to several modifications and variations all falling within the inventive concept scope.

Further, all the details may be substituted by other technically equivalent elements.

In practice better results have been obtained by using metal materials having a high heat transmission coefficient, and the specific size and shapes, may be any, depending on the needs.

I claim:

1. A finned tube provided with both external and internal fins, particularly suitable to be used as a heat exchanger, constituted by a plurality of longitudinally extended, circumferentially arranged sections, the base portion of each section being curved according to a circle arc, alternate sections overlapping the adjacent sections thereby forming the outer wall of an extended tube having alternate inner and outer sections in overlapping arrangement, each of said sections having an internal fin which extends both longitudinally and radially inwardly within said tube and terminates in the proximity of the tube circumference center, the internal fin from each of said sections forming with adjacent fins a plurality of small channels for the longitudinal flow without stagnation of fluid through the length of said tube, and a helically arranged, edge wrapped fin disposed on the outer wall of said tube.

2. The finned tube of claim 1 in which each of said sections is V-shaped in cross-section with wings extending from the spreaded, upper part of each section forming the aforesaid overlapping arrangement with adjacent sections and the inwardly extending legs of each section being the apex of the V forming an internal fin.

3. The finned tube of claim 2 in which each pair of adjacent sections are connected together by a longitudinally extended weld.

4. The finned tube of claim 3 in which each V-shaped section is formed from a plate sheet element.

5. The finned tube of claim 1 in which each of said sections is T-shaped in cross-section with the longitudinally and radially extending stem forming the internal fin and the upper wing portions of the T being arc-shaped and said wing portions forming with adjacent sections an extended tube as aforesaid.

6. The finned tube of claim 5 in which the space between each pair of alternate, overlapping wing portions is filled with longitudinally extending welding which connects said pair of wing portions to each other and the inner section therebetween.

7. The finned tube of claim 6 in which said T-sections are made by extension.

8. The finned tube of claim 1 in which the helically arranged, edge wrapped fin is notched.

* * * * *